United States Patent [19]

Abbott

[11] 4,043,306

[45] Aug. 23, 1977

[54] CARBURETOR SPACER PLATE WITH VAPOR FUEL INLET

[76] Inventor: William G. Abbott, P.O. Box 1103, Hanford, Calif. 93230

[21] Appl. No.: 613,802

[22] Filed: Sept. 16, 1975

Related U.S. Application Data

[63] Continuation-in-part of Ser. No. 476,285, June 4, 1974, abandoned, which is a continuation-in-part of Ser. No. 335,570, Feb. 26, 1973, abandoned.

[51] Int. Cl.[2] ..... F02M 13/08; F02B 77/00; F02M 23/04

[52] U.S. Cl. ..... 123/121; 123/25 R; 123/25 A; 123/198 A; 123/124 R

[58] Field of Search ..... 123/25 R, 25 A, 119 A, 123/119 B, 119 D, 119 DB, 119 E, 141, 124 R, 198 A, 121; 261/DIG. 1, DIG. 19

[56] References Cited

U.S. PATENT DOCUMENTS

| | | | |
|---|---|---|---|
| 1,576,524 | 3/1926 | Mark | 123/198 A |
| 1,610,507 | 12/1926 | Foley | 261/DIG. 1 |
| 2,269,131 | 1/1942 | Schwarz | 123/198 A |
| 2,445,479 | 7/1948 | Francis | 123/25 R |
| 2,642,089 | 6/1953 | Christie | 261/DIG. 1 |
| 3,105,471 | 10/1963 | MacPherson et al. | 123/119 B |
| 3,294,073 | 12/1966 | Bressan | 123/119 A |
| 3,437,467 | 4/1969 | Jacobus | 123/141 X |
| 3,547,090 | 12/1970 | Seliger | 123/119 B |
| 3,564,580 | 2/1971 | Cinque | 123/141 |
| 3,643,641 | 2/1972 | Busse | 123/119 D |

FOREIGN PATENT DOCUMENTS

| | | | |
|---|---|---|---|
| 536,103 | 5/1941 | United Kingdom | 123/198 A |

*Primary Examiner*—Wendell E. Burns
*Attorney, Agent, or Firm*—Clarence A. O'Brien; Harvey B. Jacobson

[57] ABSTRACT

A spacer plate for disposition between the carburetor mounting boss of an internal combustion engine intake manifold and the mounting flange of an associated carburetor is provided. The spacer plate includes an opening formed therethrough for registry with each air and fuel passage in the associated carburetor and intake manifold and an elongated vapor discharge tube extends through the spacer plate between the upper and lower surfaces thereof. At least one intermediate portion of the discharge tube extends along one peripheral portion of the opening formed through the plate and includes at least one lateral outlet opening opening into the spacer plate air and fuel opening. Those portions of the discharge tube disposed in the spacer plate are partially flattened so as to be of reduced width in a direction disposed normal to the plane of the associated spacer plate. In the instance of the spacer plate for use between a multi-barrel carburetor and an associated intake manifold the lateral opening formed in the tube opens into the primary air and fuel passage closely beneath the idle jet outlet opening of the carburetor on the side of the carburetor throttle plate which swings upwardly in response to opening of the throttle plate. Also, if the spacer plate is to be used between either a one barrel carburetor or a two barrel carburetor which does not include primary and secondary air and fuel passages, the spacer plate has its vapor discharge tube lateral outlet opening positioned closely beneath the idle jet outlet opening or openings of the associated one and two barrel carburetors.

8 Claims, 4 Drawing Figures

CARBURETOR SPACER PLATE WITH VAPOR FUEL INLET

This application comprises a continuation-in-part of my co-pending U.S. application Ser. No. 476,285, now abandoned, filed June 4, 1974, which application comprises a continuation-in-part of U.S. application Ser. No. 335,570, filed Feb. 26, 1973, now abandoned.

BACKGROUND OF THE INVENTION

In recent years, there have been laws enacted to progressively limit the exhaust emissions of internal combustion engines utilized to power motor vehicles. Each year these limits are more difficult to adhere to without major and expensive modifications to the fuel induction and exhaust systems of vehicle engines.

In order to reduce exhaust emissions with extensive and expensive modifications of this type, development has come about in the field of injection of water and fuel vapors into the intake passages of combustion engines. The injection of water and fuel vapors in this manner promotes improved combustion which in turn results in reduced exhaust emissions.

One form of vapor injector which has met with considerable operational success is the Mark II Vapor Injector marketed by Automotive Performance of America, of Culver City, Calif. While other vapor injectors have heretofore been designed, the MarK II Vapor Injector utilizes a specific alcohol based fuel and water mixture which promotes not only reduced exhaust emissions but also increases gasoline mileage and less carbon and sludge buildup.

Examples of previously patented vapor injectors and similar devices are disclosed in U. S. Pats. Nos. 3,643,641, 3,564,580, 3,547,090, 3,437,467, 3,294,073, 3,105,471, 2,642,089, 2,445,479, 2,269,131, 1,610,507 and 1,576,524, as well as Great Britain Pat. No. 536,103.

BRIEF DESCRIPTION OF THE INVENTION

The carburetor spacer plate of the instant invention has been designed to provide a means whereby supplemental fuel vapors may be introduced into the air and fuel induction system of a vehicle internal combusiton engine at a point immediately downstream from the carburetor associated with that induction system.

Specifically, the carburetor spacer plate is adapted primarily, although not necessarily, for use in conjunction with a vapor injector such as the Mark II Vapor Injector marketed by Automotive Performance of America, of Culver City, Cal. The Mark II Vapor Injector includes a reservoir for containing a supplemental fuel which is ducted, in vapor form, to the discharge tube of the spacer plate of the instant invention.

The main object of this invention is to provide a readily installable means for discharging supplemental fuel in vapor form into the air and fuel induction system of an associated internal combustion engine immediately downstream from the carburetor of the engine.

Another very important object of this invention is to provide an apparatus in accordance with the preceding object and constructed in a manner whereby the supplemental fuel discharged into the air and fuel induction system of an associated internal combustion engine will enter the air and fuel induction system immediately downstream from the idle air and fuel mixture jet outlet of the associated carburetor on the side of the corresponding air and fuel passage in which the associated throttle plate swings upwardly upon movement of the throttle plate to the open position.

Still another object of this invention is to provide an apparatus in accordance with the preceding objects and constructed in a manner whereby only a few different models will be required for adaptation to substantially all types of carburetor-to-intake manifold mounting installations.

A further object of this invention is to provide a carburetor mounting spacing plate in accordance with the preceding objects and of minimum thickness, whereby the installation of the spacer plate between an associated carburetor and intake manifold will minimize the increase in elevation of the carburetor and any throttle linkage and automatic transmission control linkage modifications which might otherwise be required.

Yet another object of this invention is to provide a spacer plate for discharging supplemental fuel in vapor form into the air and fuel induction system of an internal combustion engine and constructed in a manner whereby proper amounts of supplemental fuel in vapor form will be discharged into the air and fuel passage of the air and fuel induction system.

A final object of this invention to be specifically enumerated herein is to provide a carburetor mounting spacing plate including vapor injection inlet structure and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
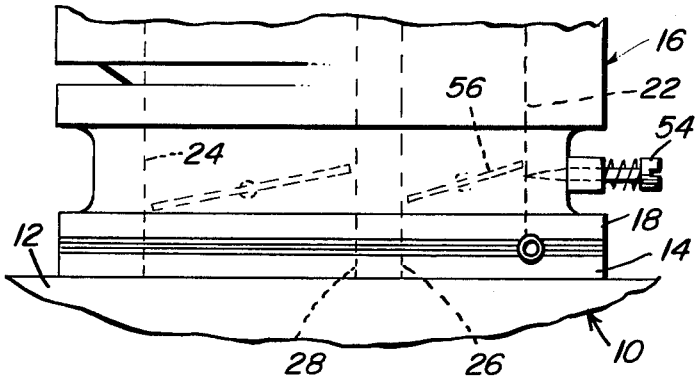
FIG. 1 is a fragmentary side elevational view of a typical carburetor-to-manifold mounting situation with the spacer plate of the instant invention interposed between the carburetor base mounting flange and the carburetor mounting boss of the intake manifold.

Referring now more specifically to the drawings the numeral 10 generally designates a conventional form of internal combustion engine including an intake manifold 12 having a carburetor mounting boss 14. Conventionally, a carburetor referred to in general by the reference numeral 16 and including a lower mounting flange 18 is mounted upon the boss 14 by means of suitable fasteners (not shown). The carburetor 16 includes primary and secondary air and fuel induction passages 22 and 24 which are registered with similar air induction passages 26 and 28 formed in the mounting boss 14 and opening downwardly into the manifold 12.

The spacer plate of the instant invention is referred to in general by the reference numeral 30 and includes a framelike body 32. The body 32 includes an opening 34 formed therethrough consisting of communicated opening sections 36 and 38.

The body 32 is of preferably three-ply construction and specified areas of the center ply are removed or omitted in order to define a passage 40 opening outwardly of one marginal edge portion 42 of the body 32. The passage 40 extends inwardly through the body 32 between the upper and lower plies thereof and extends along and opens laterally into the side of the opening section 36 remote from the opening section 38.

A tube 44 is provided and includes a cylindrical end portion 46 over which the discharge end of a flexible tube may be readily secured as well as a flattened end portion 48 which extends through the passage 40 and includes a pair of lateral bores 50 opening into the opening section 36.

The plate 30 is mounted between the mounting flange 18 of the carburetor 16 and the mounting boss 14 of the manifold 12 by first removing the carburetor 16 and placing the plate 30 over top of the mounting boss 14. Thereafter, the carburetor 16 is reinstalled and the conventional fasteners (not shown) utilized to secure the carburetor mounting flange 18 to the intake manifold mounting boss 14 are passed through the corner apertures 52 formed in the plate 30.

It is at this point stressed that the tube 44 is flattened as at 48 in order to enable the plate 30 to be interposed between the mounting flange 18 and the mounting boss 14 while elevating the carburetor 16 only slightly relative to the manifold 12. Further, if the conventional carburetor installation previously included a spacer plate, the plate 30 may be constructed so as to be of the same thickness as the original plate and comprise a substitute therefor thereby enabling reinstallation of the carburetor 16 at exactly the same height relative to the manifold 12.

With the plate 30 installed between the mounting flange 18 and the mounting boss 14, it will be noted that the outlet openings or bores 50 are spaced closely beneath the idle jets 54 controlling the idle air and fuel flow passages opening into the primary air and fuel passages 22 of the carburetor 16. Further, it will be noted that the primary air and fuel passages 22 of the carburetor 16 include throttle plates 56 having peripheral portions closely adjacent the idle air and fuel outlet ports which swing upwardly when the throttle plates 56 are swung to their open positions. Therefore, the openings or bores 50 are disposed immediately beneath the idle air and fuel discharge ports opening into the primary air and fuel passages 22. In this manner, the bores 50 are not only subject to manifold vacuum but also the air and fuel mixture entering the primary air and fuel passages 22 as that mixture is expanded upon being subject to manifold vacuum. Also, immediately upon partial opening of the throttle plates 56 the outlet ends of the bores 50 are subject to reasonably high velocity air flow further enhancing the discharge of fuel vapors from the bores 50, the aforementioned reservoir of the Mark II Vapor Injector being operably coupled to the tube 44 by means of an endless flexible tube (not shown).

Figure 4:
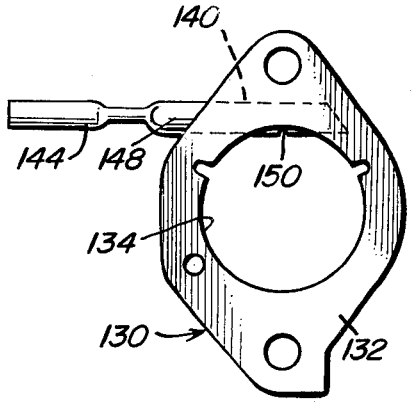
FIG. 4 is a top plan view of the carburetor spacer plate illustrated in FIG. 3.
Figure 2:
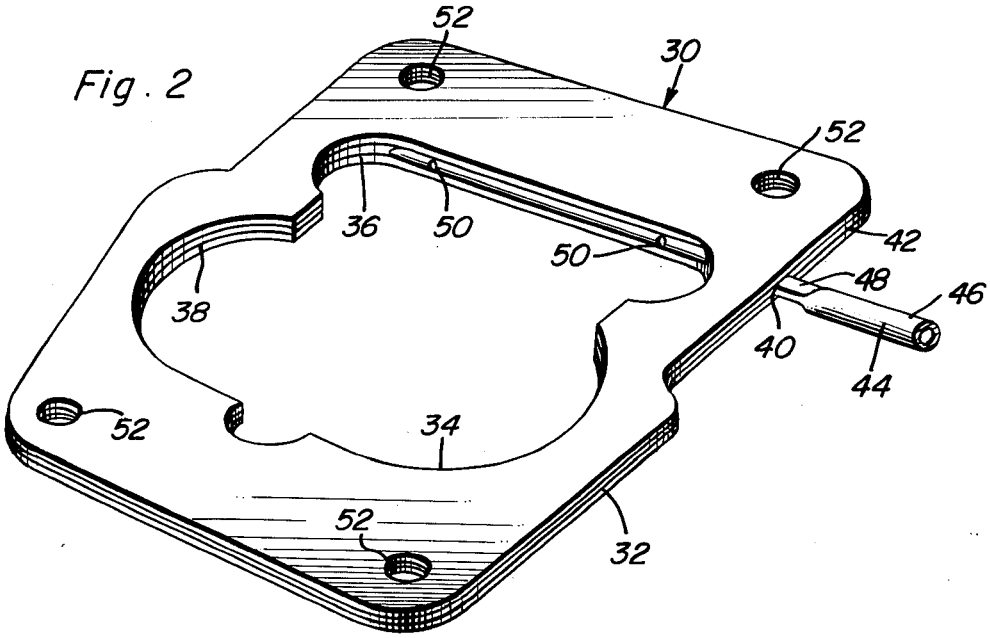
FIG. 2 is a perspective view of a first form of carburetor spacer plate with vapor fuel inlet constructed in accordance with the present invention.
Figure 3:
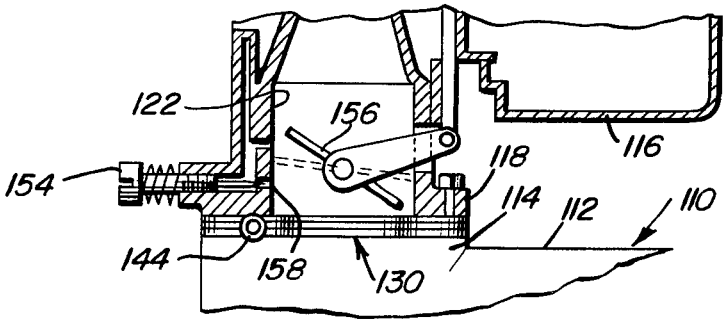
FIG. 3 is a fragmentary enlarged vertical sectional view of of a second form of carburetor spacer plate with vapor fuel inlet interposed between the carburetor base mounting flange of a single barrel carburetor and the associated mounting boss of a manifold to which the single barrel carburetor is mounted.

Referring now more specifically to FIGS. 3 and 4, a second internal combustion engine referred to in general by the reference numeral 110 is illustrated including an intake manifold 112 provided with a carburetor mounting boss 114 having a carburetor 116 with its mounting flange 118 secured to the boss 114. The carburetor 116 is of the single barrel type and includes a single air and fuel passage 122 formed therethrough.

A second form of spacer plate is referred to in general by the reference numeral 130 and also defines a framelike body 132. However, the body 132 has a single passage or opening 134 formed therethrough and also includes a passage 140 corresponding to the passage 40 in which the flattened end 148 of a tube 144 corresponding to the tube 44 is secured. The flattened end 148 includes an outlet port or bore 150 corresponding to the bores 50 and it may of course be appreciated that the plate 130 is installed between the boss 114 and the mounting flange 118.

It may further be noted that the carburetor 116 includes a throttle plate 156 corresponding to the throttle plate 56 and an idle adjustment jet 154 controlling an idle air and fuel outlet 158 opening into the passage 122. Here again, the outlet 158 is disposed immediately beneath that peripheral portion of the throttle plate 156 which is swung upwardly upon opening of the throttle plate 156. Furthermore, the outlet port or bore 150 is disposed closely beneath the outlet port 158. Therefore, it may be seen that the operation of the plate 130 is similar to the operation of the plate 30 in that supplemental fuel vapors may be discharged into the passage 134 through the port 150.

Also, the body 132 may be of three-ply construction with the passage 140 being defined by a void area of the center ply. Also, the bodies 32 and 132 may be of two-ply construction with the equivalent of the passages 40 and 140 being formed by a pair of confronting or opposing shallow recesses formed in adjacent sides of the corresponding body plies.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a carburetor body and an attendant intake manifold, said body and manifold including registered air and fuel induction passages formed therethrough, a spacer plate mounted between said body and manifold, said plate having an opening formed therethrough registered with said passages and an outer periphery extending about said opening, a supplemental fuel vapor induction tube having an inlet end portion and an outlet end portion, said tube being supported from said plate with said outlet end portion embedded in said plate and said inlet end portion projecting outwardly through one outer peripheral edge of said plate, said outlet end portion including a vapor outlet section thereof extending along one periepheral portion of said opening and provided with a lateral outlet opening transversely into said opening, said outlet end portion being closed at its end remote from said inlet end portion, a first of said air and fuel passages of said body including a pivoted throttle plate controlling the flow of air therethrough and including a free swinging edge portion swingable in an upstream direction in said first of said air and fuel passages upon said throttle plate being pivoted toward its open position, said outlet in said vapor outlet section of said tube opening into the portion of said opening formed through said plate corresponding to the portion of said first of said air and fuel passages in which said free swinging edge portion is received when said throttle plate is at least substantially closed, said body including an idle fuel outlet port opening into the last mentioned portion of said first of said air and fuel passages.

2. The combination of claim 1 wherein said plate comprises a multi-ply plate including opposite side plies constructed of shape retentive, but slightly pliable and compressible material and at least one intermediate ply, said intermediate ply having an entrance slot formed therein extending from the outer periphery thereof into said opening, said outlet end portion of said tube extending through said slot.

3. The combination of claim 2 wherein the flattened portion of said tube is of a total thickness substantially equal to the thickness of said one intermediate ply.

4. The combination of claim 1 wherein said plate is constructed of a material having low heat transfer properties.

5. A spacer plate for placement between an intake manifold carburetor mounting boss and the base of a specific carburetor mounted on said boss, said plate defining at least one opening formed therethrough for registry with registered air and fuel induction passages of said carburetor and manifold and an outer periphery extending about said opening, a supplemental fuel vapor induction tube having an inlet end portion and an outlet end portion, said tube being supported from said plate with said outlet end portion embedded in said plate and said inlet end portion projecting outwardly through one peripheral edge of said plate, said outlet end portion including a vapor outlet section thereof extending along one peripheral portion of said opening and provided with a lateral outlet opening transversely into said opening, said outlet end portion being closed at its end remote from said inlet end portion, said plate including peripheral portions thereof suitably apertured to receive the mounting bolts of said specfic carburetor therethrough, said opening formed through said plate being of a size and shape to register with the air and fuel passages extending through said specific carburetor and the location of the point at which said lateral outlet opens into said opening corresponding to the location of said air and fuel passages of said specific carburetor into which the idle air and fuel port opens.

6. In combination with a carburetor body and an attendant intake manifold, said body and manifold including registered primary and secondary air and fuel induction passages formed therethrough, a spacer plate mounted between said body and manifold, said plate having a central opening formed therethrough registered with said primary and secondary passages and an outer periphery extending about said opening, said plate including means defining an internal fuel vapor flow passage including an inlet end portion opening exteriorly of said plate and an outlet end portion including an outlet opening into said central opening in a direction extending transversely thereof, said primary air and fuel passage of said body including a pivoted throttle plate controlling the flow of air and fuel mixture therethrough and including a free swinging edge portion swingable in an upstream direction in said primary air and fuel passage upon said throttle plate being pivoted toward its open position, said outlet opening into the portion of said central opening formed through said plate corresponding to the portion of said primary air and fuel passage in which said free swinging edge portion is received when said throttle plate is at least substantially closed, said body including an idle fuel outlet port opening into the last mentioned portion of said primary air and fuel passage.

7. A spacer plate for placement between an intake manifold carburetor mounting boss and an associated carburetor, said plate defining at least one opening formed therethrough for registry with registered air and fuel induction passages of said carburetor and manifold, a supplemental fuel vapor induction tube secured through said plate intermediate the surfaces thereof opposing said body and manifold, said tube including an outlet end portion opening into said opening and an inlet end opening outwardly exteriorly of said plate and adapted to be communicated with a source of supplemental fuel vapor, said plate comprising a multiply plate including opposite side plies and an intermediate ply having a void area defining an entrance slot formed therein extending from the outer periphery thereof into said opening, said tube extending through said slot, the portion of said tube extending through said slot being partially flattened so as to be of a total thickness substantially equal to the thickness of said intermediate ply.

8. The combination of claim 7 wherein said plate is constructed of a material having low heat transfer properties.

* * * * *